US007117835B2

(12) United States Patent
Zimmerman

(10) Patent No.: US 7,117,835 B2
(45) Date of Patent: Oct. 10, 2006

(54) MOTORCYCLE STARTING SYSTEM

(75) Inventor: Arthur W. Zimmerman, Bay Village, OH (US)

(73) Assignee: Arthur Zimmerman, Bay Village, OH (US)

( * ) Notice: Subject to any disclaimer, the term of this patent is extended or adjusted under 35 U.S.C. 154(b) by 0 days.

(21) Appl. No.: 11/332,032

(22) Filed: Jan. 13, 2006

(65) Prior Publication Data

US 2006/0112923 A1 Jun. 1, 2006

(51) Int. Cl.
*F02N 11/12* (2006.01)
*F02N 11/14* (2006.01)

(52) U.S. Cl. ..... 123/179.25

(58) Field of Classification Search ..... 123/179.25, 123/179.26

See application file for complete search history.

(56) References Cited

FOREIGN PATENT DOCUMENTS

GB 2321673 A * 8/1998

* cited by examiner

*Primary Examiner*—Stephen K. Cronin
*Assistant Examiner*—Arnold Castro
(74) *Attorney, Agent, or Firm*—Fay Sharpe Fagan Minnich & McKee; Brian E. Turung

(57) ABSTRACT

A motorcycle engine starter adapted to start an engine of a motorcycle that is not equipped with an engine starter. The motorcycle engine starter includes a first and second wheel rollers, a drive motor, and an motor activator. The first and second wheel rollers are spaced apart a distance to enable a wheel of the motorcycle to be partially positioned between the wheel rollers and to be at least partially supported by the wheel rollers. The drive motor causes rotation of the first wheel roller. The motor activator designed to activate the drive motor.

28 Claims, 6 Drawing Sheets

MOTORCYCLE STARTING SYSTEM

The present invention claims priority on application Ser. No. PCT/US2004/022757 filed on Jul. 14, 2004, which in turn claims priority on U.S. Provisional Application Ser. No. 60/487,183 filed Jul. 14, 2003, both of which are incorporated herein by reference.

The present invention is directed to combustion engine starters, and is more particularly directed to starters for motorcycles.

BACKGROUND OF THE INVENTION

Motorcycles are typically started by a kick starter or an electric starter. Motorcycles that are designed for racing typically do not include starters, since the starter adds unwanted weight to the motorcycle. These types of motorcycles are typically started by placing the motorcycle in gear, pushing the motorcycle back on compression, turning the ignition and gas on and then running forward with the motorcycle. Once the rider determines that the running speed is enough to start the motorcycle, the rider quickly gets onto the seat of the motorcycle and then releases the clutch. The release of the clutches causes the gears to engage with the engine to cause the engine to start.

This common technique to start racing motorcycles has several disadvantages. One disadvantage is that the starting technique is complicated and difficult. Not all riders are capable of pushing the motorcycle at a desired velocity and then mounting the moving motorcycle prior to releasing the clutch. Another disadvantage is that the starting technique can become tiring if the motorcycle is having trouble starting. The need to run with the motorcycle several times prior to starting the motorcycle can tire the rider and result in a disadvantage to the rider during a race. Still another disadvantage is that the starting method can cause damage to the motorcycle or injury to the rider. When the clutch is released, the motorcycle may jerk, quickly stop or suddenly accelerate. This action by the motorcycle can result in the rider falling from the motorcycle or injuring the rider. Such a situation can be a great disadvantage to the rider prior to the race. Furthermore, the motorcycles may fall down or get away from the rider and result in damage to the motorcycle. The improper release of the clutch during starting can also result in damage or undue wear of the clutch, which can again be a disadvantage to the rider during a race.

In an effort to address the problems associated with the starting of racing motorcycles, racing motorcycle starters have been developed. One starter is named a "Starting Block" which is provided by TGA Ltd. Another starter is offered by Cycle Cat under the name "RMS-1". Both the TGA and Cycle Cat starters include a single motor to drive a rear roller that is used to rotate the rear wheel of a motorcycle. The TGA starter includes a chain to connect the front roller to the rear roller. The Cycle Cat starter has no drive connected to the front roller. Both starters include a motor that is powered by a battery. Both starters are equipped with a foot pedal that is used to power the electric motor.

Although both of these starters can be used to start some types of racing motorcycles, these starters cannot start all types of motors on various types of racing motorcycles. As a result, these starters have not been widely adapted by racing crews. In addition, the motorcycle can slip out of the rollers during the starting of the motorcycle and result in damage to the motorcycle and/or injury to the rider. Both of these starters have electric motors that are directly connected to a roller. During operation of the starters, the electric motor can be damaged when the motorcycle engine engages and causes the rollers to turn more rapidly than the electric motor is designed to rotate the rollers. The chain drive on the TGA starter has a tendency to fall off the gears, thus resulting in having to terminate the starting process.

In view of the state of the art with respect to motorcycle starters, there is a need for a motorcycle starter that can overcome the existing problems associated with prior motorcycle starters.

SUMMARY OF INVENTION

The present invention is directed to motorcycle starters and more particularly to an engine starter for a racing motorcycle; however, it will be appreciated that the engine starter of the present invention can be used to start engines on standard motorcycles, motor scooters, combustion engines connected to skateboards, bicycles and the like, or the engine starter can be modified to start motors on dune buggies, go-carts, or other types of combustion engines that do not include a starter.

In one aspect of the present invention, the engine starter includes a housing, a plurality of wheel rollers rotatably connected to the housing, a drive motor that is designed to drive one or more of the wheel rollers, and an motor activator to activate the drive motor to cause the one or more wheel rollers to rotate. The wheel rollers are spaced apart from one another along the longitudinal axis of the engine starter and spaced at a distance sufficient to enable a portion of a motorcycle wheel to be at least partially positioned between the wheel rollers. The wheel rollers are also designed to at least partially support the motorcycle wheel. Typically, the engine starter includes a first and second rollers wherein the first roller is positioned in the forward or front portion of the engine starter, and the second wheel roller is positioned in the rearward portion of the first wheel roller. The two wheel rollers typically have the same cross-sectional shape; however, this is not required. The cross-sectional shape of the wheel rollers is typically generally circular; however, this is not required. The cross-sectional shape and size of each of wheel rollers can be constant or varied along the longitudinal length of the wheel roller. In one non-limiting design, both of the wheel rollers have a generally cylindrical shape. In another non-limiting design, at least one of the rollers includes a varying cross-sectional size, such that the cross-sectional size decreases from one edge of the roller to the midpoint of the roller and then subsequently increases toward the other end of the roller to form a generally hourglass profile. The wheel rollers can be formed of a variety of materials such as, but not limited to, metal, plastic composite material, ceramic material, etc. Typically, the material is selected to be durable and withstand the forces and vibrations that are associated with the starting of a motorcycle engine. In one non-limiting design, each of the wheel rollers is formed of a metal material (e.g., carbon steel, stainless steel, chromium alloy, nickel alloy, etc.). One or more of the wheel rollers can be textured and/or include a coating material that is designed to reduce slippage between the wheel roller and the motorcycle wheel during the operation of the engine starter. In one non-limiting design, one or more of the wheel rollers can include a non-smooth surface (e.g., plurality of ribs, nodules, or other raised surfaces) to reduce the slippage of the motorcycle wheel on the wheel roller. In another and/or alternative non-limiting design, one or more of the wheel rollers can include a coating material and/or adhesively applied material (e.g., rubber material, plastic material, composite material, sandpaper, etc.) that is designed to reduce slippage between the wheel roller and the motorcycle wheel during the operation of the engine starter. The plurality of wheel rollers is mounted on the frame of the engine starter. The frame is typically made of a durable material such as, but not limited to, metal, wood, plastic composite materials, etc. The plurality of rollers is typically rotationally mounted to the frame by use of a bearing or non-bearing connection. In one non-limiting design, the plurality of rollers is rotatably mounted to the frame in a single location for each wheel roller. In an another and/or alternative non-limiting design, the frame includes a plurality of connection points for at least one of the wheel rollers to enable the spacing between the wheel rollers to be selectable, so as to accommodate various sizes of motorcycle wheels to be supported by the wheel rollers during the operation of the engine starter. The spacing of the wheel rollers from one another, the position at which the wheel rollers are mounted onto the frame and/or the diameter of the wheel rollers can be selected, so as to enable the wheel of the motorcycle to be positioned between the wheel rollers and also be elevated from the bottom surface of the engine starter or ground surface on which the engine starter lies, so as to enable the motorcycle wheel to be rotated by the wheel rollers without the motorcycle wheel engaging a ground surface or the bottom surface of the frame of the engine starter. The drive motor on the engine starter is typically designed to drive the first wheel roller in a clockwise direction, so as to cause the motorcycle wheel that is positioned between the plurality of wheel rollers to rotate in a counterclockwise direction. The drive motor is selected to have a sufficient horsepower (hp) rating to cause the first wheel roller to rotate at a sufficient velocity to start a wide variety of racing motorcycles. In one non-limiting design, the horsepower of the drive motor is at least about one horsepower, typically at least about two horsepower, and more typically about two to nine horsepower. As can be appreciated, other horsepower ratings for the drive motor can be used. The drive motor is typically an electric motor; however, a combustion motor (i.e. combustion engine) can be used. The electric drive motor is an motor that is generally designed to be powered by a 12V, 18V or 24V power source. As can be appreciated, the electric drive motor can be powered by other voltage levels. The electric drive motor can be powered by, but not limited to, a dedicated battery source, a vehicle battery, electrical power generated by an engine or motor driven generator, or a power grid (e.g., power outlet on a building). When the power source is a dedicated battery power source, the one or more batteries used to power the drive motor are typically rechargeable; however, this is not required. When the power source is a vehicle battery, the engine starter is provided with a sufficiently long power cable to enable the drive motor to be conveniently connected to a vehicle battery. When the power source for the drive motor is a power grid or an engine or motor driven generator, a power cord with a plug is typically provided with the engine starter so that the power cord can be conveniently plugged into a socket in the engine or motor driven generator or a power outlet that is available at a particular location. As can be appreciated, a transformer can be provided to convert the voltage level and/or current level being generated by the power source (e.g., a battery, power grid, engine or motor driven generator, etc.) to a proper current and voltage to be used by the drive motor. The transformer, if used, can be incorporated in the engine starter or be a separate component. The drive motor is also selected, so as to generate a wheel roller speed which is sufficient to drive the motorcycle wheel a sufficient velocity to start the motorcycle engine. Typically, the drive motor is designed to drive one or more of the wheel rollers at least about 500 rpm, typically at least about 1,500 rpm, and more typically about 1,500–6,000 rpm. The rpms at which the drive rollers rotate generally cause the rotation speed of the motorcycle tire to be at least about 5 mph, and more typically, at least about 8 mph, and even more typically, about 10–30 mph; however, it can be appreciated that other speeds of the motorcycle wheel can be generated by the engine starter.

In another and/or alternative aspect of the present invention, the engine starter is formed of components which resist undue wear and corrosion. The housing is typically formed of materials that facilitate in protecting the other components of the engine starter from damage or undue wear. Typically, the housing is made up of metal material such as coated or painted carbon steel and/or aluminum materials; however, other or additional materials can be used. The coating material on the carbon steel can be a metal coating and/or a painted coating to protect the carbon steel from undue corrosion. Aluminum materials are advantageous in that such materials resist corrosion and are lightweight, so as to reduce the weight of the engine starter.

In still another and/or alternative aspect of the present invention, the engine starter includes at least one wheel to facilitate in the transport of the engine starter to various locations. The wheel can be either permanently or detachably connected to the housing of the engine starter. The wheel can be adjustably connected to the housing of the engine starter, so as to properly position the wheel when transporting the engine starter and to reposition the wheel when the engine starter is to be used to start the engine of a motorcycle. Typically, the housing includes two wheels; however, this is not required. The housing of the engine starter can also include a handle to facilitate in the grasping the engine starter when it is to be transported to various locations.

In yet another and/or alternative aspect of the present invention, the engine starter includes a loading ramp to facilitate in the movement of the motorcycle wheel onto the engine starter and between the wheel rollers, and to also facilitate in the movement of the motorcycle of the engine starter after the motorcycle engine has been started. The loading ramp is typically made of a durable material such as, but not limited to, a metal, plastic material, composite material or the like that can be used to support the weight of the motorcycle when it is being loaded and unloaded from the engine starter. The loading ramp can include one or more gripping elements to facilitate in the movement of the motorcycle on and/or off the engine starter. The loading ramp further can be permanently connected or detachably connected to the frame of the engine starter. The loading ramp can be pivotly connected to the housing to enable the loading ramp to be pivoted between a stored position and a use position. The frame of the engine starter typically includes a single loading ramp positioned at the front portion of the engine starter; however, it can be appreciated that the engine starter can include a loading ramp positioned at the rear of the engine starter, or include two loading ramps wherein one loading ramp is positioned at the front of the engine starter and the other loading ramp is positioned at the rear of the engine starter.

In accordance with a further and/or alternative aspect of the present invention, the engine starter includes a motorcycle wheel positioning mechanism to facilitate in maintaining the position of the motorcycle wheel in a desired location on one or more of the wheel rollers. During the starting of a motorcycle engine, the motorcycle wheel that is driven by one or more of the wheel rollers can have a tendency to move along the axis of the wheel roller resulting in possible slippage of the motorcycle and/or the motorcycle wheel engaging a portion of the frame of the engine starter. Such movement of the motorcycle wheel can interfere with the starting of the motorcycle and/or result in the motorcycle wheel jumping off of the engine starter. Typically, during the starting of the motorcycle engine, the rider positions the rear wheel of the motorcycle between the wheel rollers of the engine starter and applies the front brake of the motorcycle to limit movement of the motorcycle during the starting of the engine. The rider then uses his/her feet to maintain the rear wheel of the motorcycle in position on the wheel rollers during the starting of the motorcycle engine. The engine starter of the present invention can include one or more arrangements to also facilitate in maintaining the wheel of the motorcycle in a desired position on the wheel rollers. In one embodiment of the invention, one or more of the wheel rollers have a shape along the longitudinal axis of the roller which facilitates in maintaining the motorcycle wheel in a certain position on the roller. In one non-limiting design, the wheel roller includes an hourglass design to cause the motorcycle wheel to maintain itself in the narrowest portion of the dry roller. As can be appreciated, a plurality of the wheel rollers may include an hourglass design. In another and/or alternative embodiment of the invention, the wheel rollers include a generally conical shape so as to cause the motorcycle wheel to move to the portion of the roller having the smallest diameter. When the wheel rollers are positioned such that the largest diameter of one wheel roller is on the same side of the frame of the engine starter as the smallest diameter of the other wheel roller, the forces being applied by the two wheel rollers onto the motorcycle wheel result in a self-centering system during the operation of the engine starter. In still another and/or alternative embodiment of the invention, the housing includes a plurality of side bars and/or wheels that are designed to engage the side of the frame of the motorcycle when the motorcycle wheel wanders from a desired position on the wheel rollers. The side bars and/or wheels can include a non-abrasive or scratching material so as to limit damage to the frame of the motorcycle when the frame encounters the side bars and/or wheels.

In still a further and/or alternative aspect of the present invention, the engine starter includes an motor activator that is designed to turn the one or more drive motors on or off. The motor activator includes an activation mechanism that can be used by the rider or a crew member of the rider to control the activation and deactivation of the one or more drive motors. In one embodiment of the invention, the activation mechanism can include a pedal activator that allows the rider to contact the pedal with the foot of the rider to activate and deactivate the one or more drive motors. In another and/or alternative embodiment of the invention, the activation mechanism includes a switch that is connected to the handlebar of the motorcycle to enable the rider to activate and deactivate the one or more drive motors. In still another and/or alternative embodiment of the invention, the activation mechanism includes a switch, which is handheld by the rider and/or a crew member, that is used to activate and deactivate the one or more drive motors. The activation mechanism can be designed to be connected to the one or more drive motors and/or power supplies via an electrical cable and/or by one or more wireless connections (e.g., RF signal, IR signal, etc.). In still another and/or alternative embodiment of the invention, the activation mechanism can include a display which provides various types of information with respect to the motor starter. Such information can include, but is not limited to, low-battery indicator, motor rpms, wheel roller rpms, battery status indicator, motor status indicator, etc.

In still a further and/or alternative aspect of the present invention, the engine starter includes a plurality of drive motors to drive each wheel roller on the engine starter. Typically, the engine starter includes a first and second wheel rollers that are spaced apart a distance to enable a wheel of the motorcycle to be partially positioned between the wheel rollers and to be partially supported by the wheel rollers. One drive motor is connected to the first wheel roller to cause rotation of the wheel roller. A second drive motor is connected to the second wheel roller to cause rotation of the second wheel roller. Typically, the drive motors are the same type and size and generate a similar horsepower; however, this is not required. In one embodiment of the invention, the engine starter includes an motor drive controller which can be used to monitor the speed of the various drive motors and to cause the plurality of drive motors to maintain a constant speed. In one non-limiting design, the motor controller controls the amount of power being supplied to the plurality of drive motors so as to facilitate in controlling the speed of the drive motors. As can be appreciated, many different control structures can be used by the motor controller to control and regulate the speed of the various drive motors. As can be appreciated, an motor drive controller is not required when a plurality of drive motors are used. When a plurality of drive motors is used, the motor activator on the engine starter is designed to activate and/or deactivate the plurality of drive motors at substantially the same time.

In still yet a further and/or alternative aspect of the present invention, the engine starter includes a single drive motor, which is used to drive a plurality of wheel rollers. In certain applications, the motorcycle engine does not require a large amount of force to drive the motorcycle wheel to start the engine. In such applications, a single drive motor can be used to start the motorcycle engine of the motorcycle. In this particular arrangement, the drive motor is typically connected to the wheel roller located in the forward portion of the engine starter, and the wheel roller are connected by a gear arrangement, drive rod and/or chain connection and sprocket connection to cause such wheel rollers to rotate. As can be appreciated, the drive motor can be connected to the other wheel roller. When a gear arrangement, a chain arrangement and/or a drive rod arrangement are used to cause rotation of one or more of the wheel rollers, typically these arrangements are contained within a protective enclosure in the housing of the engine starter so as to limit or prevent exposure of these arrangements to dirt and/or other foreign materials which can result in the impairment of the operation of the engine starter.

In another and/or alternative aspect of the present invention, the engine starter includes a gear arrangement that is connected between a drive motor and a wheel roller. The gear arrangement is designed to efficiently and effectively cause a wheel roller to be rotated by the drive motor. In one embodiment of the invention, a gear arrangement is provided for each drive motor. In another and/or alternative embodiment of the invention, the gear arrangement enables the engagement and disengagement of the drive motor from the wheel roller. In one non-limiting design, the gear arrangement engages and causes a wheel roller to rotate when the drive motor is activated. In another and/or alternative non-limiting design, the gear arrangement disengages from the wheel roller when the drive motor is deactivated.

In one non-limiting arrangement of this design, the wheel roller is allowed to freely rotate when the gear arrangement disengages from the wheel roller. In still another and/or alternative non-limiting design, the gear arrangement minimizes damage to the wheel roller and/or drive motor when the wheel roller is rotating at a slower or faster rate than that rate at which the drive motor is designed to rotate the wheel roller. Such an arrangement prevents or limits damage to the gears and/or damage to the components of the drive motor during the operation of the engine starter. In yet another and/or alternative non-limiting design, the gear arrangement can include multiple gear ratios to enable an operator to select a particular gear ratio for a particular motorcycle engine. In another and/or alternative embodiment of the invention, at least one gear arrangement includes a Bendix pinion arrangement is used to connect the drive motor to the wheel roller. In one non-limiting design, the Bendix pinion arrangement is designed to form a connection between the drive motor and the wheel roller when the drive motor is activated. In this design, a gear on the Bendix pinion arrangement moves into engagement with a gear or sprocket on a wheel roller to cause the wheel roller to begin rotating. In one particular configuration of this design, the gear or sprocket on the wheel roller has tapered front edges on the teeth to facilitate in the engagement of the gear on the Bendix pinion arrangement with the gear or sprocket on a wheel roller. The teeth of the gear or sprocket are tapered at an angle of about 5–45°; however, it can be appreciated that other angles can be used. Each tooth of the gear or sprocket has a width that is generally the same. The taper in the sprocket or gear is generally less that 50% of the width of the tooth, typically less than about 25%, more typically less than about 10%, and even more typically less than about 5%. The gear or sprocket on the roller wheel is typically made of a durable material such as, but not limited to metal; however, other material can be used. If the gear or sprocket is made of metal, the metal is typically hardened; however, this is not required. The top surface of each tooth can also have tapered surfaces; however, this is not required. When the top surface of the tooth is tapered, typically the full top of the tooth is tapered. In another and/or alternative non-limiting design, the Bendix pinion arrangement forms a connection between the drive motor and the wheel roller to enable the drive motor to become disengaged from the wheel roller when the rpm of the drive motor does not properly correspond to the rpm of the wheel roller. This situation can arise when the motorcycle engine engages and causes the wheel of the motorcycle to temporarily rotate the engaged wheel rollers at a higher or lower rpm than the drive motor is driving the wheel rollers. In such a situation, the Bendix pinion arrangement allows the drive motor to disengage from the wheel roller, thereby limiting or preventing damage to the drive motor and/or gear or sprocket on the wheel roller.

In yet another and/or alternative aspect of the present invention, the engine starter includes a bumper roller positioned in the rear region of the engine starter. The bumper roller is designed to at least partially engage the motorcycle wheel, which is positioned between the wheel rollers of the engine starter. The bumper roller is designed to inhibit or prevent the motorcycle wheel from prematurely climbing out of or disengaging from the wheel rollers during the starting of the motorcycle engine. The bumper roller also facilitates in obtaining equal weight distribution of the motorcycle wheel on the wheel rollers. The bumper roller can be fixed in a single position on the engine starter or be adjustably positioned on the engine starter. In one embodiment of the invention, the bumper roller can be adjustably positioned relative to the motorcycle wheel so as to facilitate in properly positioning the bumper roller on various sized motorcycle wheels. In one non-limiting design, the bumper roller can be repositioned by a ratchet arrangement wherein a flange on the bumper roller includes a plurality of slots, and a particular slot is used to position the bumper roller in a desired position. In another and/or alternative non-limiting design, the bumper roller can be repositioned by use of a flange on the bumper roller that includes a plurality of position opening that are used to position the bumper roller in a desired position. As can be appreciated, many other and/or additional arrangements can be used to adjustably position the bumper roller. In still another and alternative non-limiting design, the bumper roller includes a positioning mechanism and/or a spring or other type of compression mechanism to cause the bumper roller to maintain engagement with the motorcycle wheel during the operation of the engine starter. In yet another and/or alternative non-limiting design, the bumper roller can be positioned in an operational position and a storage position. In still yet another and/or alternative non-limiting design, the bumper roller can include one or more rollers or wheels that are designed to engage the motorcycle wheel.

In yet another and/or alternative aspect of the present invention, the housing of the engine starter includes one or more foot rests, which enable a rider to maintain his/her balance on the motorcycle during the starting of the motorcycle engine. The one or more foot rests on the housing of the engine starter can include a non-slip surface to facilitate in reducing slippage of the rider's boot or shoe from the foot rest during the operation of the engine starter.

In still yet another and/or alternative aspect of the present invention, the engine starter can include one or more anchor arrangements used to facilitate in maintaining the engine starter in position during the starting of a motorcycle engine. During the operation of the engine starter, the forces applied by the wheel rollers on the motorcycle wheel can cause the frame of the engine starter to inadvertently move. This inadvertent movement can cause the undesired repositioning of the motorcycle wheel on the wheel roller, thereby resulting in improper starting of the motorcycle engine. The one or more anchors on the engine starter are designed to maintain the position of the housing of the engine starter during the operation of the engine starter. In one embodiment of the invention, the one or more anchors can include one or more ground stakes, which are driven into a ground surface to secure the housing to a ground surface, and one or more high-friction surfaces (e.g., ribs, nodules, and/or other raised surfaces) positioned at one or more positions on the base of the housing that are designed to facilitate engaging a ground surface on which the engine starter lies.

In still a further and/or alternative aspect of the present invention, the engine starter includes a conveyor belt that is positioned over a plurality of wheel rollers. Certain types of motorcycles such as motocross motorcycles, include wheels having very knobby surfaces. The knobby surfaces of the motorcycle wheel can be difficult to rotate by the use of wheel rollers on the engine starter. The use of a conveyor belt facilitates in the rotation of these knobby motorcycle tires. The conveyor belt is typically made up of a durable material which resists undue wear during the operation of the engine starter.

In yet a further and/or alternative aspect of the present invention, the engine starter includes a housing having one or more components that are precision cut, so as to facilitate in the engagement of the gear arrangement with the wheel roller. The precision cut components can be cut by a laser cutting method, a water jet cutting method, and/or other types of precision cutting methods. The precision cutting of one or more components facilitates in controlling the backlash between the mating of the gears between the gear arrangement and the roller wheel, thereby facilitating in the operation of the engine starter and further reducing damage and/or undue wear to one or more of the components of the engine starter. The precision cutting of one or more housing components also facilitates in the ease of assembly of the engine starter and reduces the incidence of improper assembly of the engine starter. In one embodiment of the invention, the plate of the housing to which a drive motor is mounted is precision cut, and the mount position for the wheel rollers is precision cut, so that when the drive motor and wheel roller is mounted, the position error of the gear or sprocket on the roller wheel relative to the gear on or interconnected to the drive motor that is designed to engage the gear or sprocket on the roller wheel is less than about 100/1000ths of an inch out of alignment, typically less than about 50/1000ths of an inch out of alignment, and more typically less than about 10/1000ths of an inch out of alignment.

One object of the present invention is the provision of an engine starter which facilitates in the starting of a motorcycle or other type of vehicle that is absent a starter.

In another and alternative object of the present invention is the provision of an engine starter which can start the engine of a wide variety of motorcycles.

In yet another and/or alternative object of the present invention is the provision of an engine starter which inhibits or prevents undesired movement or disengagement of a motorcycle wheel from the engine starter during the starting of the motorcycle engine.

In still yet another and/or alternative object of the present invention is the provision of an engine starter which facilitates in the ease of positioning a wheel of the motorcycle in the engine starter.

In a further and/or alternative object of the present invention is the provision of an engine starter which facilitates in maintaining the position of a wheel of a motorcycle on one or more wheel rollers during the operation of the engine starter.

In still a further and/or alternative object of the present invention is the provision of an engine starter which can be easily activated and deactivated by a rider and/or a crew member of the rider.

In yet a further and/or alternative object of the present invention is the provision of an engine starter which includes a connection arrangement between the drive motor and a wheel roller to facilitate in the drive of the wheel rollers by the drive motor and to inhibit and/or prevent damage to one or more components of the drive motor and/or wheel roller.

In still yet a further and/or alternative object of the present invention, there is a provision of an engine starter which includes a Bendix pin arrangement connected between a drive motor and a wheel roller to facilitate in the drive of the wheel roller by the drive motor and to prevent or inhibit damage to the drive motor and/or wheel roller during the operation of the engine starter.

In another and/or alternative object of the present invention is the provision of an engine starter which includes precision cut components such as by, but not limited to, laser cutting and/or water jet cutting to limit or prevent the backlash between mating gears of the engine starter.

In still another and/or alternative object of the present invention is the provision of an engine starter which includes a foot rest arrangement designed to facilitate in the positioning of the motorcycle on the engine starter by the rider during the operation of the engine starter.

In yet another and/or alternative object of the present invention is the provision of an engine starter which includes a conveyor belt designed to rotate certain types of motorcycle wheels in order to facilitate in the starting of the motorcycle engine.

In still yet another and/or alternative object of the present invention is the provision of an engine starter which includes tapered gears or sprockets to facilitate in the operation of the engine starter.

These and other objects and advantages will become apparent from the following description taken together with the accompanying drawing.

BRIEF DESCRIPTION OF DRAWINGS

Reference may now be made to the drawings, which illustrate various embodiments that the invention may take in physical form and in certain parts and arrangements of parts wherein.

EMBODIMENTS OF THE INVENTION

Figure 1:
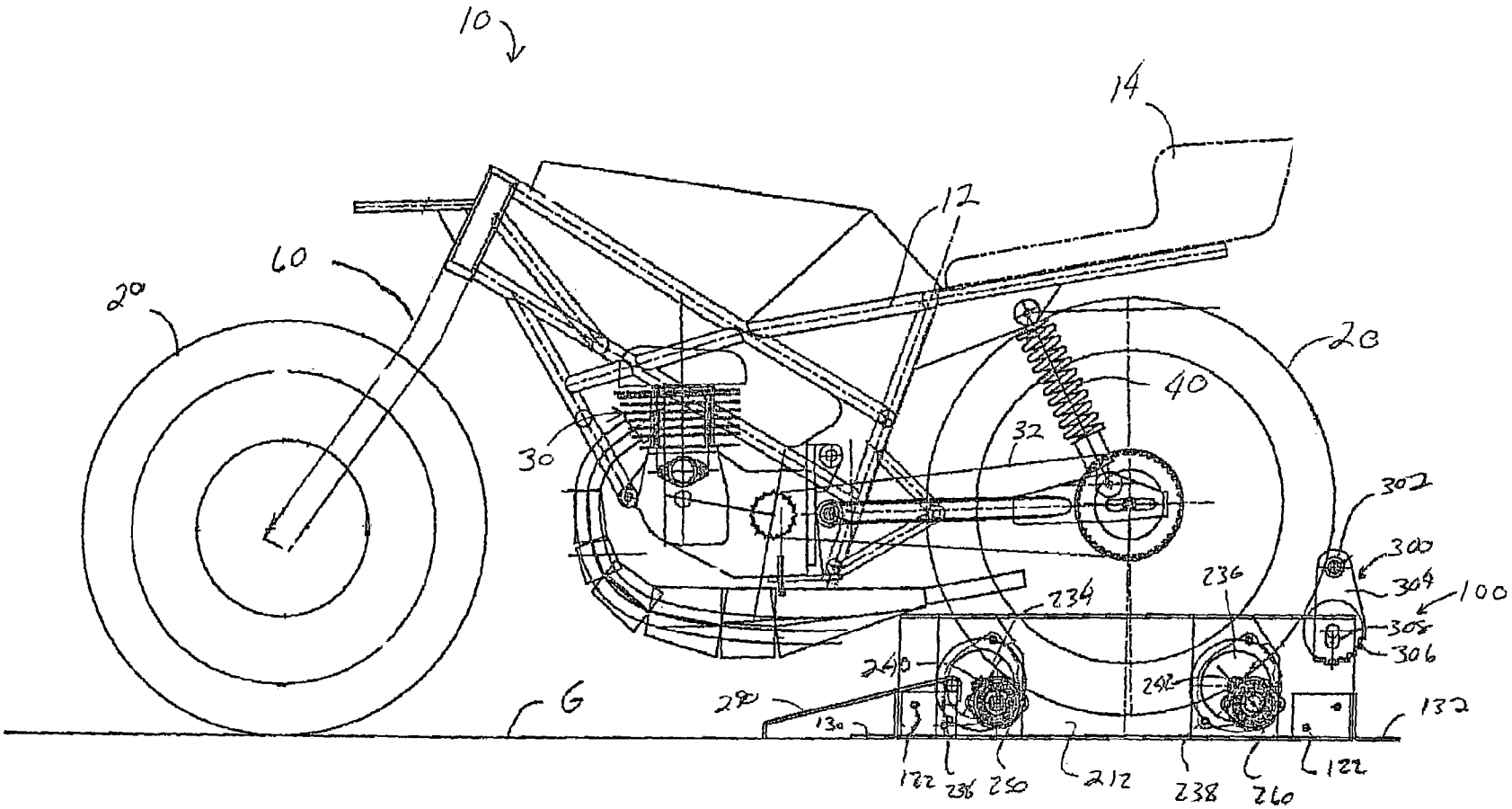
FIG. 1 is a side elevation view of a motorcycle position on the engine starter of the present invention.

Referring now to the drawings wherein the showings are for the purpose of illustrating the preferred embodiments only and not for the purpose of limiting same, FIG. 1 illustrates a general depiction of a motorcycle 10 that has a rear wheel 20 positioned in an engine starter 100. The motorcycle is illustrated as a racing motorcycle that does not include a starter and will be described with reference thereto; however, it can be appreciated that the engine starter 100 can be used to start an engine of a variety of types of motorcycles. Motorcycle 10 includes an engine 30 that drives a chain 32 which is used to rotate rear wheel 20. The rear wheel is shown to be connected to frame 12 of the motorcycle. A shock 40 is also illustrated as connected to the rear wheel of the motor cycle. The motorcycle includes a seat 14, a handlebar, not shown, and a front wheel 50 connected to a fork 60. The general structure of a motorcycle is well known in the art and is further described in U.S. Pat. No. 6,736,230 and references cited therein, all of which are incorporated herein by reference, thus further details relating to the motorcycle structure will not be further described herein.

Figure 2:
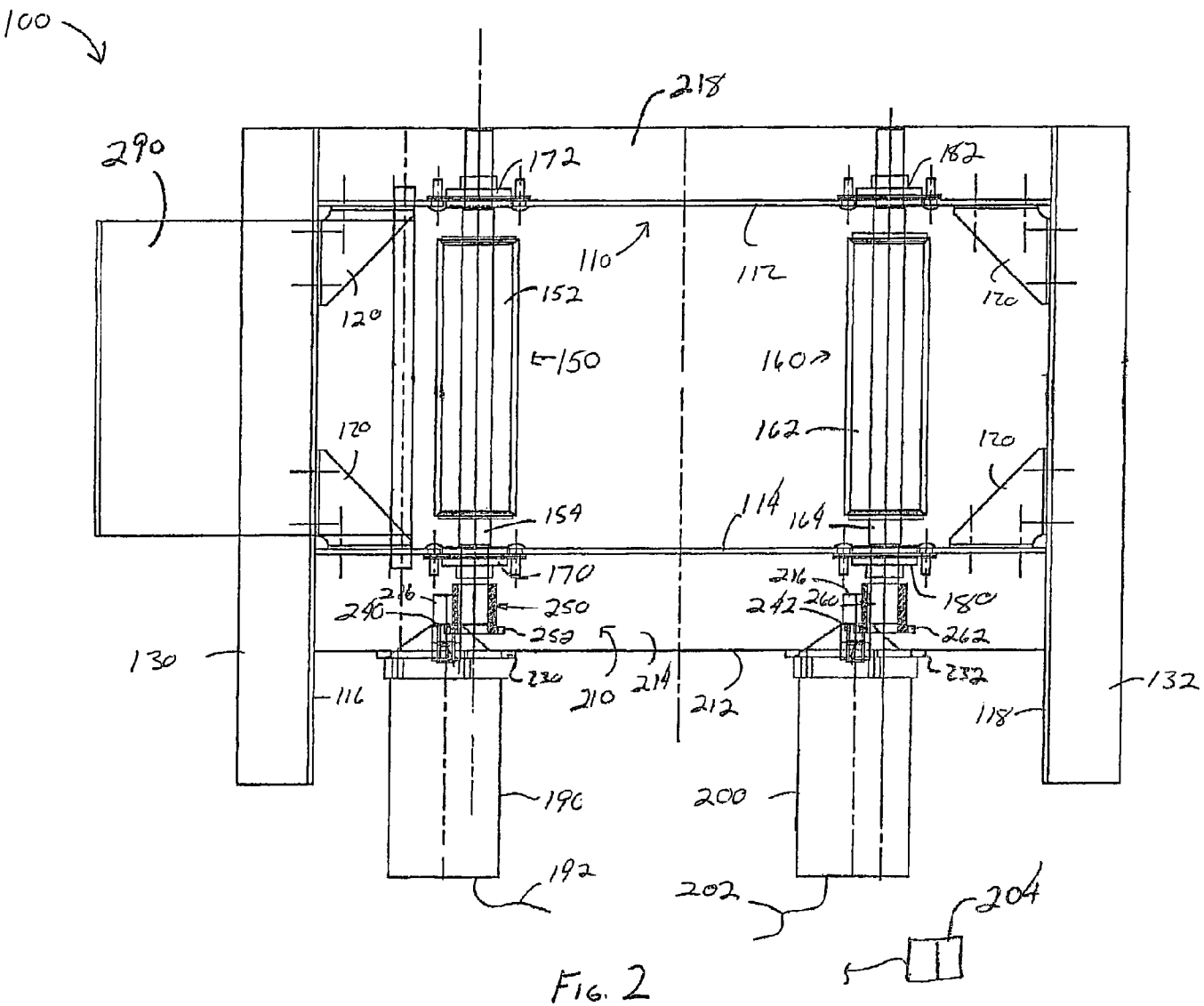
FIG. 2 is a top view of the engine starter of FIG. 1.

As illustrated in FIG. 2, the engine starter 100 includes a frame 110 formed of two side flanges 112, 114 extending generally parallel to one another and generally along the longitudinal axis of the housing. The housing also includes a front and rear flange 116, 118 extending generally parallel to one another and generally along the horizontal axis of the housing. The flanges are generally formed of a metal material (e.g., carbon steel, stainless steel, aluminum, etc.) and are typically welded together; however, it can be appreciated that other and/or additional materials can be used to form one or more of the flanges, and/or other and/or additional arrangements can be used to connect one or more of the flanges together. As illustrated in FIG. 2, corner brackets 120 are used to provide structural rigidity to the housing. The corner flanges are typically welded and bolted via bolt holes 122 to the flanges forming the housing; however, it will be appreciated that other or additional securing arrangements can be used. The front and rear flanges are illustrated as including a base flange 130, 132. The base flanges are designed to provide stability to the housing when positioned on a ground surface. Although not shown, one or both of the base flanges can include an anchoring arrangement to facilitate in securing the housing to a ground surface during the operation of the engine starter.

Two drive or wheel rollers 150, 160 are rotatably connected to side flanges 112, 114. The wheel rollers are each formed of a drive cylinder 152, 162 that is secured to a drive axial 154, 164. As can be appreciated, the drive roller can be alternatively formed from a single component. The surface of the drive cylinders can include a gripping surface to facilitate in engaging and rotating rear wheel 20. Each end of the axial of each wheel roller is rotatable connected by a bearing arrangement to the side flanges. A mount plate 170, 172 is provided for each end portion of drive axial 154, and a mount plate 180, 182 is also provided for each end portion of drive axial 164. The mount plates are illustrated as bolted to the side flanges; however, it will be appreciated that other or additional mounting arrangements can be used. Drive axial 154 and 64 are illustrated as extending through side flange 112. As can be appreciated, this is not required. When drive axial 154, 164 are designed to extend beyond side flange 112, a chain and sprocket arrangement and/or a gear arrangement, not shown, can be connected to the drive axials.

Figure 3:
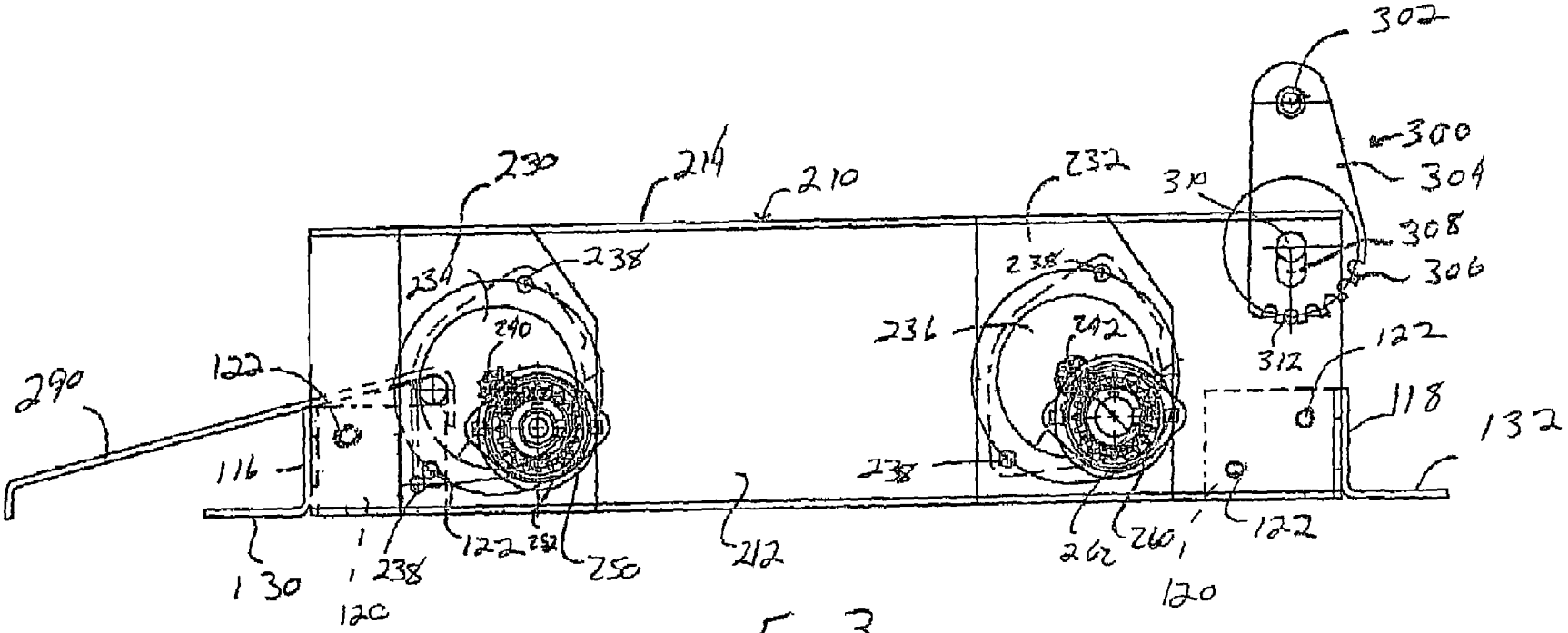
FIG. 3 is an enlarged side elevation view of the engine starter of FIG. 1.
Figure 7:
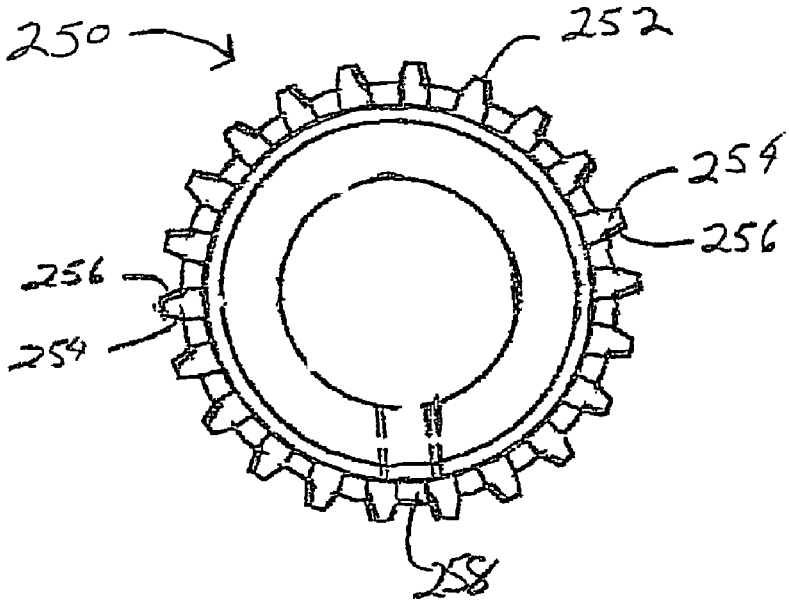

As also shown in FIG. 2, two drive motors or engines 180, 200 are mounted to a motor flange 230, 232, which in turn, are connected to side 212 motor housing flange 210. The motor housing flange 210 is connected to side flange 114 of housing 110. The motor housing flange is designed to provide a protective housing to the components that rotatably connect the drive motors to the roller wheels. An axial housing flange 218 is connected to side flange 112, which also provides a protective housing to the components of the engine starter. As shown in FIG. 3, each motor flange includes an access opening 234, 236 to provide access to the interior of the housing formed from the motor housing flange. Each motor flange also includes connection holes 238 used to secure the drive motor to the motor flange. As can be appreciated, the drive motors can be connected to the motor flange in other or additional ways. Each motor is an electric motor that generates about 2–4 horsepower on a 12V power source. An electric cord 192,202 is used to supply power to the electric motors. Typically, a rechargeable battery, not shown, is used to power the electric motors. The electric motors are typically bolted to the motor flange via connection holes 238; however, other and/or additional connection arrangements can be used. A foot pedal 204 is typically used to activate and deactivate the electric motors. The motor housing flange can be secured to side flange 114 by a variety of arrangements such as, but not limited to, a weld, bolts and nuts, rivets, etc. The motor flange and side flange are precision cut, so that the motor housing flange is properly positioned relative to the drive axial 154, 164 extending through side flange 114. Connected to the drive shaft of each electric motor is a Bendix pin arrangement 240, 242. The general configuration and operation of a Bendix pin arrangement is known in the art, thus will not be described in detail herein. The Bendix pin arrangement is designed to engage the teeth 252, 262 on the gear 250,260 that is connected to drive axial 154, 164. As best illustrated in FIG. 7, gear 250 includes a plurality of teeth 252. The front face 254 of each tooth includes a taper 256. The taper is designed to facilitate in the engagement of the Bendix pin arrangement with the gear. Typically, the taper is about 5–30°. The taper forms less than about 75% of the front face of each tooth, and typically less than about 50% of the front face of each tooth, and more typically less than about 33% of the front face of each tooth. The taper also extends less than about 50% of the width of each tooth, and typically less than about 25% of the width of each tooth. The gear 250 typically includes a connection hole 258 that is designed to receive a threaded connector, not shown, to secure the gear to the drive axial of each drive roller. The drive axial can include a slot of other tooled region, not shown, that is engaged by the threaded connector to facilitate in the connection of the gear to the drive axial. As can be appreciated, other and/or additional mechanisms can be used to connect the gear to the drive axial.

In operation, the Bendix pin arrangement is designed to move into engagement with gears 250, 260 when drive motors 190 and 200 are activated. The Bendix pin arrangement is also designed to move out of engagement with gears 250, 260 when drive motors 190 and 200 are deactivated. When the Bendix pin arrangement disengages from the gears, the wheel rollers are allowed to freely spin on drive axial 154, 164. The Bendix pin arrangement is also designed to disengage from gears 250,250 when the rotational speed of the wheel roller is unacceptably faster or slower than the speed at which the drive motors are attempting to rotate the wheel rollers. The top 214 of housing flange 210 includes two openings 216 that are designed to provide clearance for the movement of the Bendix pin arrangement. As can be appreciated, the housing flange can be designed so as to eliminate openings 216.

Referring again to FIG. 2, a loading ramp 290 is pivotly secured to side flanges 112, 114 of housing 110. The loading ramp facilitates in the movement of rear tire 20 onto and off of the engine starter. The pivot connection for the loading ramp enables the loading ramp to be folded onto or removed from the housing of the engine starter to facilitate in the ease at which the engine starter can be packed and/or stored.

As illustrated in FIGS. 1 and 3, the engine starter includes a bumper wheel arrangement 300 that is designed to facilitate in maintaining rear wheel 20 on wheel rollers 150, 160 during the operation of the engine starter. The bumper wheel arrangement includes a bumper roller 302 rotatably secured to a bumper flange 304 and another bumper flange, not shown. The bumper flange 304 is pivotly secured to side flange 212. A corresponding bumper flange, not shown, is also pivotly secured to side flange 214. The base of bumper flange 304 includes a plurality of ratchet teeth 306 that enable the bumper flange to be positioned relative to rear wheel 20. The bumper flange includes a slot 306 that enable the bumper flange to be lifted and then rotated about a bolt head 310 to a new position and then lowered so that the slot engages pinion 312 to lock the bumper flange in position.

Figure 4:
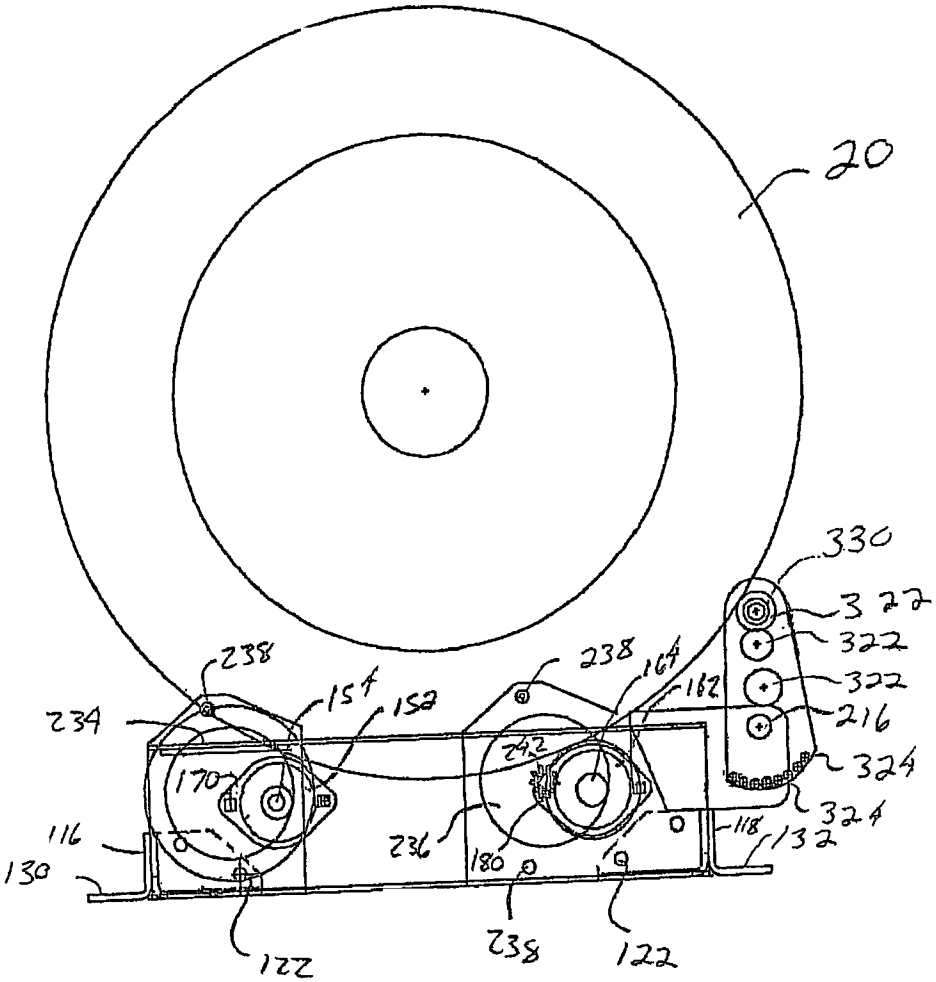
FIG. 4 is an enlarged side elevation view of a modified engine starter in accordance with the present invention.

Referring now to FIG. 4, a modified configuration of the bumper arrangement is shown. The bumper arrangement 300 includes a bumper flange 320 that includes a plurality of openings 322 that are used to rotatably secure the bumper roller 330 to the bumper flange. As can be appreciated, the multiple openings 322 can be used to secure more than one bumper roller to the bumper flange. The bottom of the bumper flange 320 includes a plurality of connection holes 324 that are used to securely position the bumper roller(s) relative to rear wheel 20 of motorcycle 10. The connection holes are designed to receive a lock pin or connection bolt, not shown, to secure the bumper flange in position. The bumper flange includes a rotation opening 326 that enables the bumper flange to pivot on side flange 212.

Figure 5:
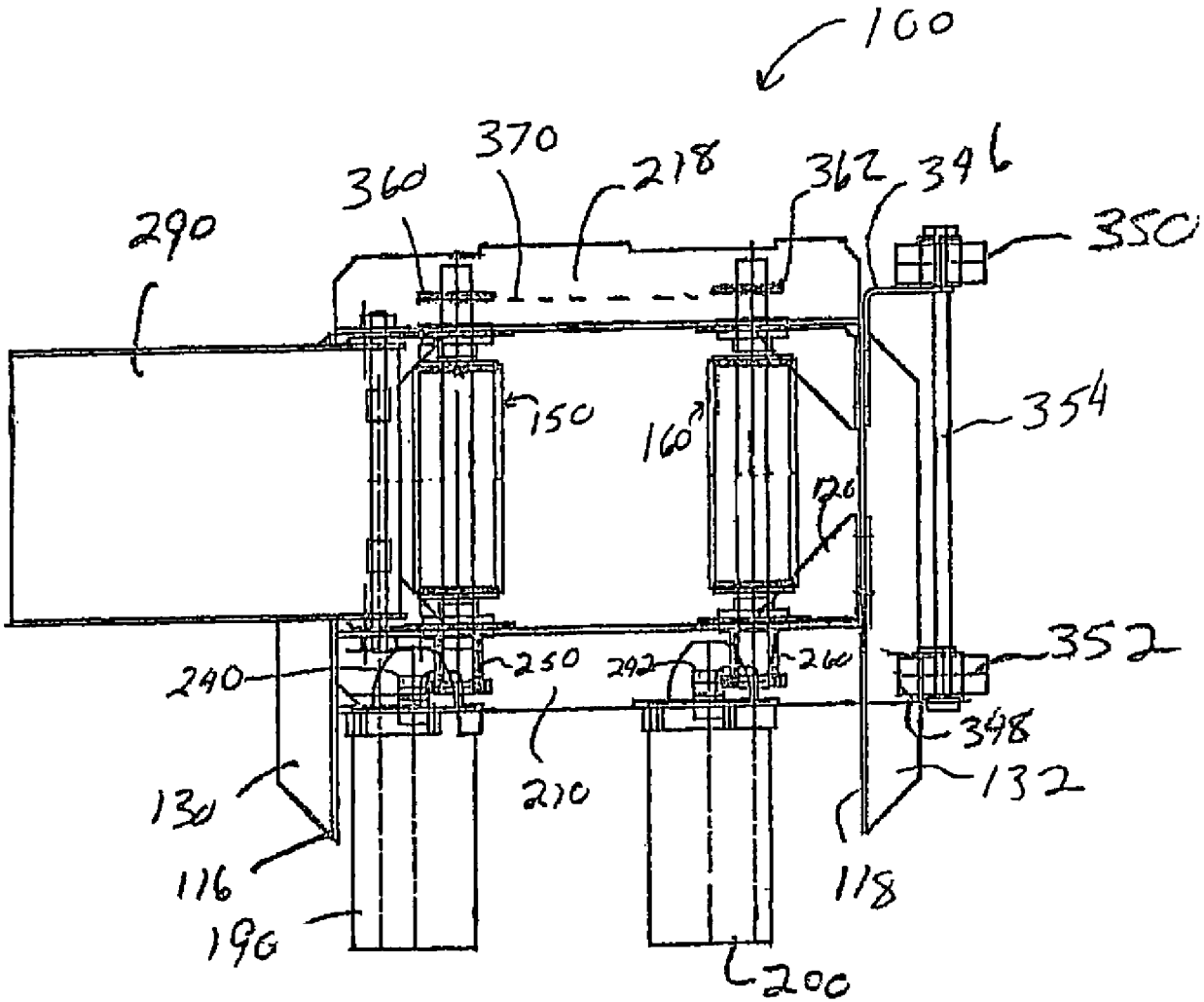
FIG. 5 is a top view of a modified engine starter in accordance with the present invention.

As illustrated in FIG. 5, a set of wheels 350, 352 can be connected to the rear flange 118 of housing 110. The set of wheels is connected to an axial 354 which is rotatably supported on two wheel flanges 346, 348 that are connected to the rear flange 118. Wheels 350, 352 are designed to facilitate in moving the engine starter to different locations. A handle, not shown, can be connected to the front flange 116.

The engine starter illustrated in FIG. 5 also discloses drive axial 154, 164 including a chain sprocket 360, 362. A chain 370 is illustrated as connected to the two sprockets. Axial housing flange 218 provides protection to the sprockets and chain from dirt and debris during the operation of the engine starter. Although the engine starter in FIG. 5 is disclosed as including two drive motors 190, 200, it can be appreciated that drive motor 200 can be disengaged or eliminated when starting smaller engines. Driver motor 190 can be used to drive both wheel rollers by used of the chain 370.

Figure 6:
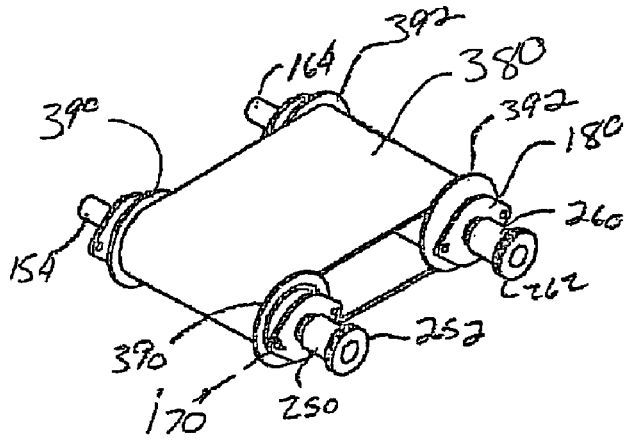
FIG. 6 is a modified version of the wheel roller arrangement of the engine starter in accordance with the present invention; and, FIG. 7 is a front view of a wheel roller gear used in the engine starter in accordance with the present invention.

Referring now to FIG. 6, there is illustrated a modification to the wheel roller arrangement of the engine starter. The wheel rollers 150, 160 are modified to accept a conveyor belt 380. Each of the wheel rollers includes side flanges 390, 392 to maintain the conveyor belt on the wheel rollers. The conveyor belt arrangement is used to start motorcycles that have knobby tire, such as motor cross racing motorcycles. The knobby tire on such motorcycles sometimes does not properly engage with the wheel roller configuration illustrated in FIG. 2. The use of a conveyor belt arrangement overcomes this problem.

The operation of the engine starter will be described. The rear wheel of motorcycle 10 is initially rolled up loading ramp 290 and onto wheel rollers 150 and 160. As illustrated in FIG. 1, the wheel rollers are sized and spaced apart such that the rear wheel is supported by the wheel roller above a ground surface G. Once the rear wheel is properly positioned onto the wheel rollers, the bumper roller arrangement 300, if used, is adjusted so as to properly position the bumper roller 302 closely adjacent to rear wheel 20. Prior to activating drive motors 190, and 200, the ride of the motorcycle engages the front brake of the motorcycle to limit or prevent movement of the motorcycle during the starting of the engine. The rider also uses his/her feet to limit the sideways Movement of the motor cycle. Also, prior to activating the drive motors, the rider places the motorcycle in gear. Different types of motorcycles may have different recommendations for the gear to be selected during the engine starting process. Once the motorcycle is in gear, the rider then presses foot pedal 204 to activate the drive motors 190, 200. Upon activation of the drive motors, the Bendix pin arrangements 240, 242 move into engagement with gear 250, 260 of wheel rollers. 150, 160. The rotation of the wheel rollers causes the rear wheel 20 to begin rotating. Typically, the rear wheel is rotated by the engine starter at about 12–20 mph. The rotating of the rear wheel eventually causes the motorcycle engine to start. Once the motorcycle engine is started, the rider presses or releases the foot pedal to cause the drive motors to deactivate. The deactivation of the drive motors results in the Bendix pin arrangements 240, 242 moving out of engagement with gear 250, 260 of wheel rollers 150, 160, thereby resulting the wheel rollers to freely rotate with the rear wheel of the motorcycle. After the drive motors are deactivated, the rider places the motorcycle in neutral and then pushes the motorcycle forward to cause the rear wheel roll off the wheel rollers and down the loading ramp of the engine starter.

The invention has been described with reference to preferred and alternate embodiments. Modifications and alterations will become apparent to those skilled in the art, upon reading and understanding the detailed discussion of the invention provided herein. This invention is intended to include all such modifications and alterations insofar as they come within the scope of the present invention.

Having thus defined the invention, the following is claimed:

1. A motorcycle engine starter adapted to start an engine of a motorcycle comprising a frame, first and second wheel rollers rotatably mounted on the frame, a first and second drive motors, and an motor activator, said first and second wheel rollers spaced apart a distance to enable a wheel of the motorcycle to be partially positioned between said wheel rollers and to be at least partially supported by said wheel rollers, said first drive motor causing rotation of said first wheel roller, said second drive motor causing rotation of said second wheel roller, said motor activator designed to activate said first and second drive motors.

2. The motorcycle engine starter as defined in claim 1, wherein said motor activator activates both drive motors at substantially the same time.

3. The motorcycle engine starter as defined in claim 1, including a first and second gear arrangement, said first gear arrangement connected between said first drive motor and said first wheel roller, said second gear arrangement connected between said first drive motor and said second wheel roller, said first gear arrangement engageable and disengageable from said first wheel roller, said second gear arrangement engageable and disengageable from said second wheel roller.

4. The motorcycle engine starter as defined in claim 3, wherein said first gear arrangement includes a first Bendix pinion arrangement connected between said first drive motor and said first wheel roller, and said second gear arrangement includes a second Bendix pinion arrangement connected between said second drive motor and said second wheel roller, said first Bendix pinion arrangement engaging said first wheel roller during an activation of said first drive motor and disengaging from said first wheel roller during a deactivation of said first drive motor, said second Bendix pinion arrangement engaging said second wheel roller during an activation of said second drive motor and disengaging from said second wheel roller during a deactivation of said second drive motor.

5. The motorcycle engine starter as defined in claim 1, including a bumper roller designed to engage a wheel of said motorcycle positioned on said first and second wheel rollers, said bumper roller designed to inhibit said motorcycle wheel from prematurely disengaging from at least one of said wheel rollers.

6. The motorcycle engine starter as defined in claim 5, wherein said bumper roller is adjustably positionable relative to said motorcycle wheel.

7. The motorcycle engine starter as defined in claim 1, wherein said motor activator includes an activation mechanism selected from the group consisting of a foot switch, a handlebar switch, a handheld switch, a wireless switch or combinations thereof.

8. The motorcycle engine starter as defined in claim 1, including a pair of foot rests.

9. The motorcycle engine starter as defined in claim 1, including a conveyor belt, said conveyor belt being driven by said first and second wheel rollers.

10. The motorcycle engine starter as defined in claim 3, wherein said frame includes a wheel roller axial opening and a drive motor access opening, said wheel roller axial opening and a drive motor access opening controllably spaced from one another and at least partially formed by a cutting technique selected from the group consisting of laser cutting, water jet cutting or combinations thereof.

11. The motorcycle engine starter as defined in claim 1, wherein said first wheel roller includes a gear having a plurality of sprockets, at least two of said sprockets having a tapered edge to facilitate in the engagement of said first gear arrangement with said first wheel roller.

12. The motorcycle engine starter as defined in claim 1, wherein said second wheel roller includes a gear having a plurality of sprockets, at least two of said sprockets having a tapered edge to facilitate in the engagement of said second gear arrangement with said second wheel roller.

13. A method for starting a motorcycle engine on a motorcycle that is not equipped with an engine starter comprising:

a. providing an engine starter having a frame, first and second wheel rollers rotatably mounted to the frame, a first drive motor, an motor activator, said first and second wheel roller spaced apart a distance to enable a wheel of the motorcycle to be partially positioned between said wheel rollers and to be at least partially supported by said wheel rollers, said first drive motor causing rotation of said first wheel roller, said motor activator designed to activate said first drive motor;

b. positioning a wheel of said motorcycle between said first and second wheel rollers, said wheel of said motorcycle engaged with said motorcycle engine;

c. activating said drive motor to cause rotation of said first wheel roller and to also cause rotation of said motorcycle wheel;

d. maintaining activation of said first drive motor until said motorcycle engine starts; and, e. moving said motorcycle off said first and second wheel rollers.

14. The method as defined in claim 13, including a second drive motor to cause rotation of said second wheel roller.

15. The method as defined in claim 13, including a first gear arrangement connected between said first drive motor and said first wheel roller.

16. The method as defined in claim 15, wherein said first gear arrangement is engageable and disengageable from said first wheel roller.

17. The method as defined in claim 15, wherein said first gear arrangement includes a first Bendix pinion engageable with said first wheel roller during activation of said first drive motor and disengageable from said first wheel roller during deactivation of said first drive motor.

18. The method as defined in claims 15, including a second gear arrangement connected between said second drive motor and said second wheel roller, said second gear arrangement is engageable and disengageable from said second wheel roller.

19. The method as defined in claim 18, wherein said second gear arrangement includes a second Bendix pinion engageable with said second wheel roller during activation of said second drive motor and disengageable from said second wheel roller during deactivation of said second drive motor.

20. The method as defined in claim 13, wherein said first wheel roller includes a gear having a plurality of sprockets, at least two of said sprockets having a tapered edge to facilitate in the engagement of said first gear arrangement with said first wheel roller.

21. The method as defined in claim 13, wherein said second wheel roller includes a gear having a plurality of sprockets, at least two of said sprockets having a tapered edge to facilitate in the engagement of said second gear arrangement with said second wheel roller.

22. The method as defined in claim 13, including the step of activating both drive motors at substantially the same time.

23. The method as defined in claim 13, including the step of inhibiting said motorcycle wheel from prematurely disengaging from said wheel rollers during the starting of said motorcycle engine.

24. The method as defined in claim 13, wherein said step of activating said first drive motor includes an activation mechanism selected from the group consisting of a foot switch, a handlebar switch, a handheld switch, a wireless switch or combinations thereof.

25. The method as defined in claim 13, including the step of forming at least one wheel roller axial opening and at least one drive motor access opening in said frame, said wheel roller axial opening and a drive motor access opening controllably spaced from one another and at least partially formed by a cutting technique selected from the group consisting of laser cutting, water jet cutting or combinations thereof.

26. The method as defined in claim 13, wherein at least one of said wheel rollers includes a shape to facilitate in maintaining a position of said motorcycle wheel on said wheel roller.

27. The method as defined in claim 13, wherein said frame includes a plurality of positioners to facilitate in maintaining a position of said motorcycle wheel on said wheel roller.

28. The method as defined in claim 13, wherein said frame includes at least one wheel to facilitate in the movement of said frame of said engine starter over a ground surface.

* * * * *